US007686860B2

(12) United States Patent
Ryan

(10) Patent No.: US 7,686,860 B2
(45) Date of Patent: Mar. 30, 2010

(54) DEBRIS RECEIVER

(75) Inventor: John W. Ryan, Boise, ID (US)

(73) Assignee: Drawervac, LLC, Boise, ID (US)

( * ) Notice: Subject to any disclaimer, the term of this patent is extended or adjusted under 35 U.S.C. 154(b) by 842 days.

(21) Appl. No.: 11/500,213

(22) Filed: Aug. 7, 2006

(65) Prior Publication Data

US 2007/0234690 A1 Oct. 11, 2007

Related U.S. Application Data

(60) Provisional application No. 60/744,599, filed on Apr. 11, 2006, provisional application No. 60/743,631, filed on Mar. 22, 2006.

(51) Int. Cl.
*B01D 53/00* (2006.01)

(52) U.S. Cl. ..... 55/429; 55/428; 55/DIG. 18; 55/385.1; 454/49; 312/1; 312/209; 312/211; 312/212; 312/229; 312/237

(58) Field of Classification Search ..... 55/428, 55/429, DIG. 18, 385.1; 454/49–67; 312/1, 312/209, 211, 212, 229, 237, 330.1–348.6
See application file for complete search history.

(56) References Cited

U.S. PATENT DOCUMENTS

| | | | | | |
|---|---|---|---|---|---|
| 3,180,145 | A | * | 4/1965 | St Clair | 73/278 |
| 3,233,952 | A | * | 2/1966 | Valentine | 312/229 |
| 3,559,383 | A | * | 2/1971 | McCabe | 55/472 |
| 3,716,282 | A | * | 2/1973 | Propst et al. | 312/322 |
| 3,819,049 | A | * | 6/1974 | Koerner et al. | 209/250 |
| 4,227,902 | A | * | 10/1980 | Olson | 55/302 |
| 4,809,391 | A | * | 3/1989 | Soldatovic | 15/301 |
| 4,852,935 | A | * | 8/1989 | Varner | 296/146.14 |
| 5,408,721 | A | | 4/1995 | Wall et al. | |
| 6,131,527 | A | * | 10/2000 | Park et al. | 112/282 |
| 6,428,122 | B1 | * | 8/2002 | Henry et al. | 312/1 |
| 6,783,563 | B1 | * | 8/2004 | Eckhoff et al. | 55/356 |
| 6,875,248 | B1 | * | 4/2005 | Shelton et al. | 55/356 |

FOREIGN PATENT DOCUMENTS

| | | | |
|---|---|---|---|
| CA | 642 539 | A | 6/1962 |
| CA | 675 552 | A | 12/1963 |
| DE | 19 74 313 | U | 12/1967 |
| DE | 297 06 247 | U1 | 6/1997 |

OTHER PUBLICATIONS

International Search Report for Application No. PCT/US2007/064289 mailed Nov. 22, 2007.
International Preliminary Report On Patentability for application No. PCT/US2007/064289, mailed Jun. 3, 2008.

* cited by examiner

*Primary Examiner*—Jason M Greene
*Assistant Examiner*—Dung Bui
(74) *Attorney, Agent, or Firm*—Zarian Midgley & Johnson PLLC

(57) ABSTRACT

In one embodiment, a drawer for receiving debris into a suction debris collection system includes: a floor; walls extending up from the floor, the floor and the walls defining a chamber having a forward part and a rearward part; an outlet from the rearward part of the chamber; and a seal configured to prevent the passage of air through an opening to the suction system when the drawer is in a closed position and suction is supplied to the opening.

9 Claims, 10 Drawing Sheets

DEBRIS RECEIVER

CROSS REFERENCE TO RELATED APPLICATIONS

This application claims subject matter disclosed in U.S. provisional patent application Ser. No. 60/744,599 filed Apr. 11, 2006 titled Central Vacuum System With Integrated Countertop Debris Collector and U.S. provisional patent application Ser. No. 60/743,631 filed Mar. 22, 2006 titled Central Vacuum System With Integrated Countertop Debris Collector.

BACKGROUND

Central vacuum systems, used increasingly in homes and businesses, provide centralized debris collection and eliminate the need to move around a heavy motor and collector bag or canister while cleaning. These systems are adapted to provide suction to many different areas in homes, offices and other facilities. In a typical conventional central vacuum system, suction ports located in walls and other concealed locations are accessed through long portable hoses that plug into the ports. Debris is collected through the hoses in much the same way that debris is collected with a portable vacuum except, of course, without the need to move around the motor and the collector bag or canister. Embodiments of the present invention were developed in an effort to facilitate removing debris from countertops, desktops, work benches, and similar types of work surfaces utilizing components of a central vacuum system.

DRAWINGS

DETAILED DESCRIPTION

As used in this document: "drawer" means a sliding receptacle opened by pulling or pushing and closed by pushing or pulling; "port" means an opening for the intake or exhaust of air; "seal" means a device that prevents the passage of air into a passage or container; "suction" means reduced air pressure or the act or process of exerting a force upon a solid, liquid, or gaseous body by reason of reduced air pressure; and "valve" means a device by which the flow of liquid, gas, or loose material may be started, stopped, or regulated by a movable part that opens, shuts, or partially obstructs a port or passage.

Figure 1:
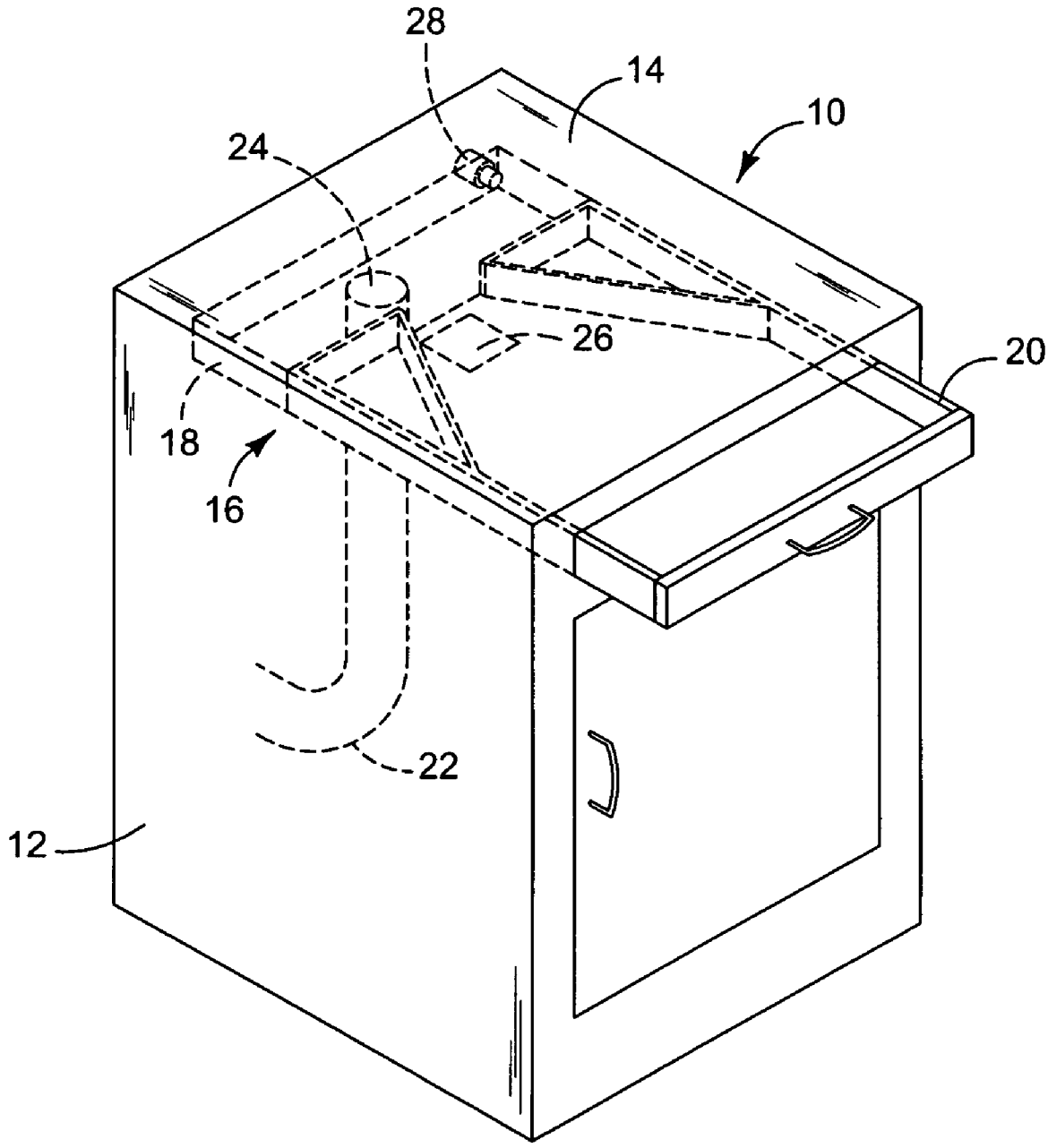
FIG. 1 illustrates a cabinet according to an embodiment of the invention.

FIG. 1 illustrates a cabinet 10 such as might be utilized at various locations in a home or business. Referring to FIG. 1, cabinet 10 includes a base 12, a countertop 14 on base 12, and a debris receiver assembly 16 mounted in base 12 just below countertop 14. Receiver assembly 16 includes a drawer receptacle 18 fixed in base 12 and a debris receiving drawer 20 that slides in receptacle 18. A duct 22 runs from a suction port 24 at the back of receptacle 18 to a central vacuum (not shown in FIG. 1). Suction port 24 represents generally any suitable opening in receptacle 18 that allows suction supplied by the central vacuum through duct 22 to reach drawer 20 when drawer 20 is open. A seal 26 is positioned in the floor of drawer 20 to close suction port 24 when drawer 20 is closed and seal port 24 when suction is supplied to port 24. Hence, when drawer 20 is closed, the central vacuum can suck air in through other suction ports, if any, in the central vacuum system. A switch 28 may be used to automatically turn on the central vacuum when drawer 20 is opened and to automatically turn off the central vacuum when drawer 20 is closed. Switch 28 represents generally any suitable electrical, electronic, optical, or other switching device and circuitry operable to turn on the central vacuum when drawer 20 is opened and to turn off the central vacuum when drawer 20 is closed. If the central vacuum system includes other suction ports, switch 28 is configured to allow the central vacuum to run when drawer 20 is closed.

Seal 26 in drawer 20 functions as a valve that starts and stops the flow of air through drawer 20 into duct 22. If drawer 20 is closed, seal 26 closes and, when suction is supplied to port 24, seals suction port 24 so that air will not flow through drawer 20 into duct 22 when suction is supplied to port 24. If drawer 20 is open, suction port 24 is also open so that air will flow through drawer 20 into duct 22 when suction is supplied to port 24. The speed of air flowing through drawer 20 into duct 22 may be increased by minimizing the entry of air into receptacle 18 and duct 22 other than through the open drawer 20. Air will also flow faster through drawer 20 when drawer 20 is more closed and slower when drawer 20 is more open. Hence, as drawer 20 closes the rate of air flow increases to help draw debris in drawer 20 back into duct 22. As shown in FIG. 1, the sides of drawer 20 may be tapered towards the rear, behind the debris entry area, to help make the air flow faster and to direct debris toward suction port 24. Drawer 20 might also be tapered between the top and bottom toward the rear to help make the air flow faster behind the debris entry area.

Figure 2:
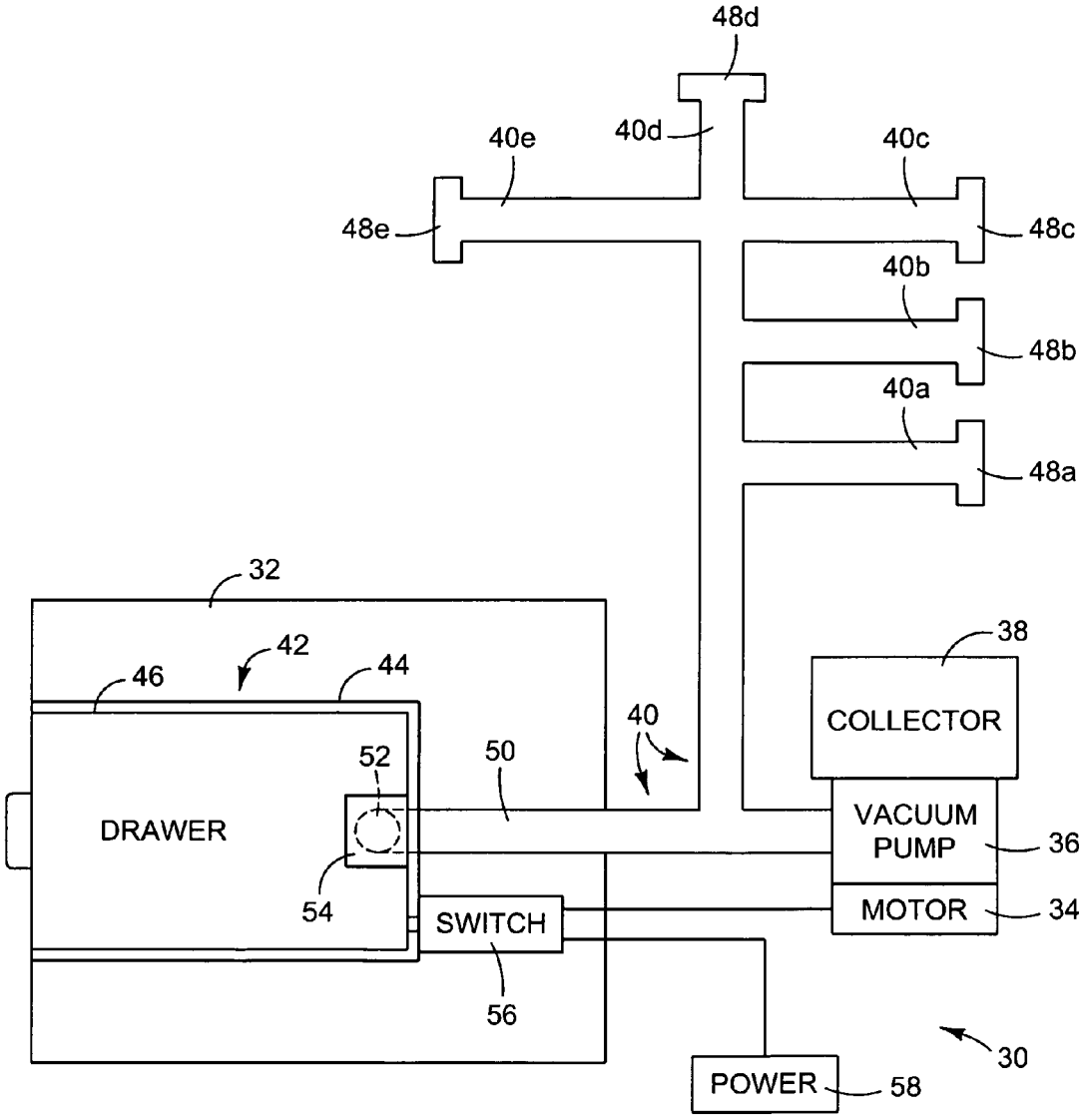
FIG. 2 illustrates a countertop debris collection system according to an embodiment of the invention.
Figure 3:
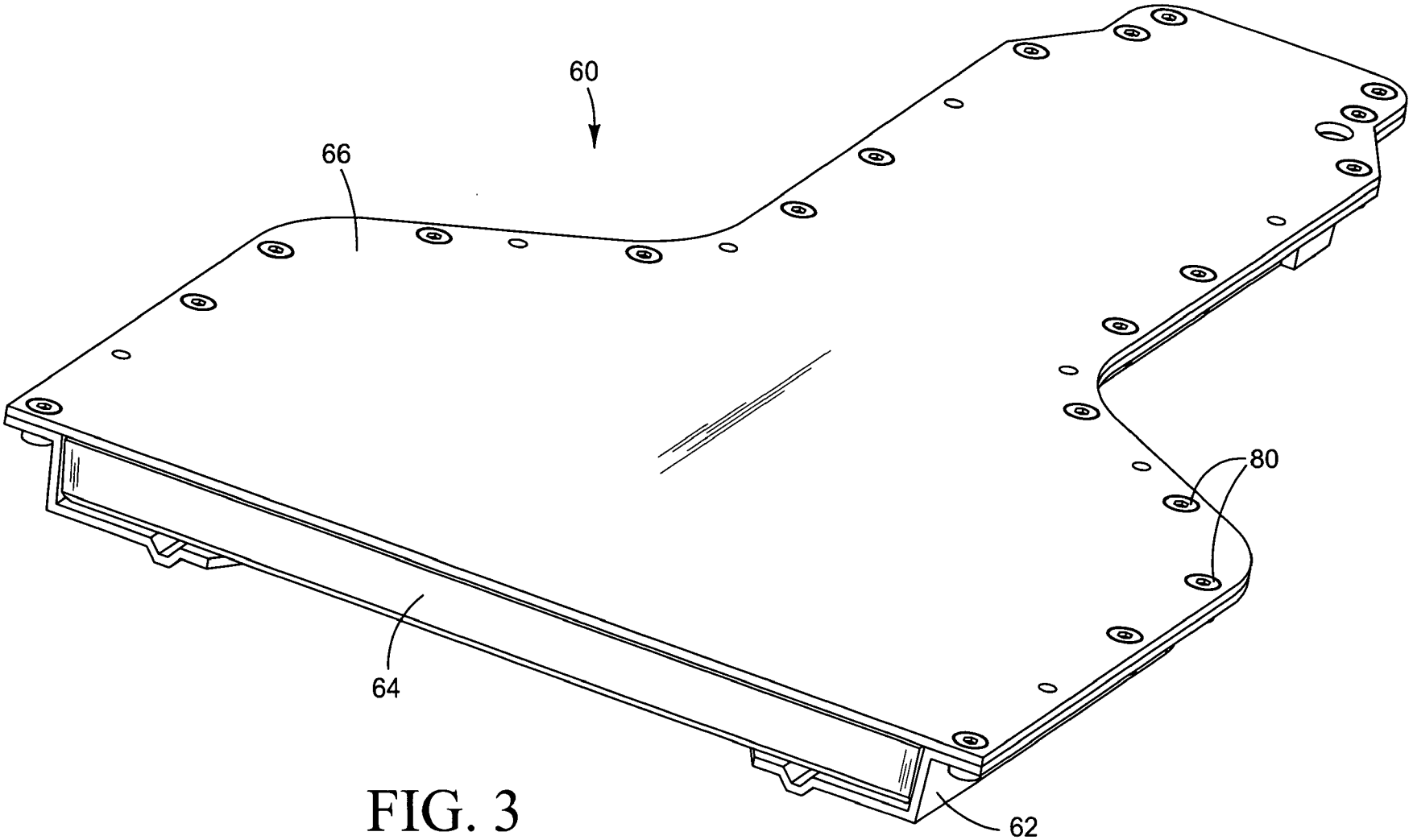
FIGS. 3-6 are perspective views of a debris receiver assembly according to an embodiment of the invention.

FIG. 2 is a block diagram illustrating a countertop debris vacuum collection system 30 utilizing, for example, a cabinet 32 such as the one shown in FIG. 1. Referring to FIG. 2, system 30 includes a motor 34, a vacuum pump 36, a collector 38, and ducting 40 typically used in conventional central vacuum systems. System 30 also includes a debris receiver assembly 42 mounted in cabinet 32. Receiver assembly 42 in FIG. 2 includes a drawer receptacle 44 fixed in cabinet 32 and a debris receiving drawer 46 that slides in receptacle 44. Ducting 40 in system 30 will usually include multiple ducts 40*a*-40*e* to multiple suction ports 48*a*-48*e* in addition to duct 50 to suction port 52 in cabinet 32. A seal 54 operatively connected to drawer 46 seals suction port 52 when drawer 46 is closed and suction is supplied to port 52. A switch 56 operatively connected to drawer 46 automatically turns on pump 36 with the use of power supply 58 when drawer 46 is opened and automatically turns off pump 36 when drawer 46 is closed.

In operation, opening drawer 46 opens suction port 52 and "activates" switch 56 to the on position to start vacuum pump 36. Pump 36 supplies suction to port 52 at the back of receptacle 44 through duct 50. Any debris swept off the top of cabinet 32 or otherwise dumped into the open drawer 46 is sucked through the rear of drawer 46, into receptacle 44, and then into duct 50 through suction port 52 and on to collector 38. Closing drawer 46 closes suction port 52 and "deactivates" switch 56 to turn off vacuum pump 36.

Figure 4:
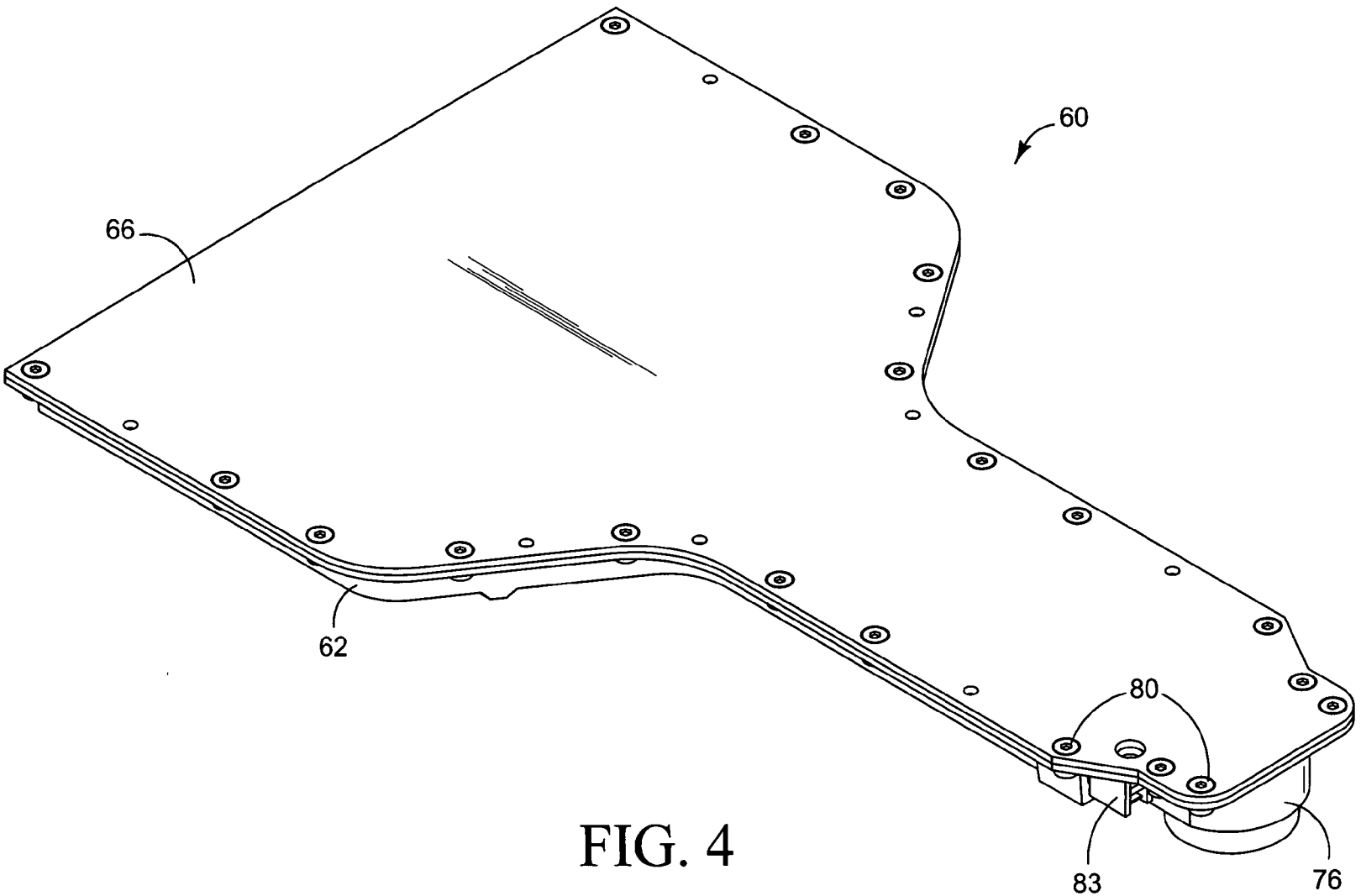
Figure 5:
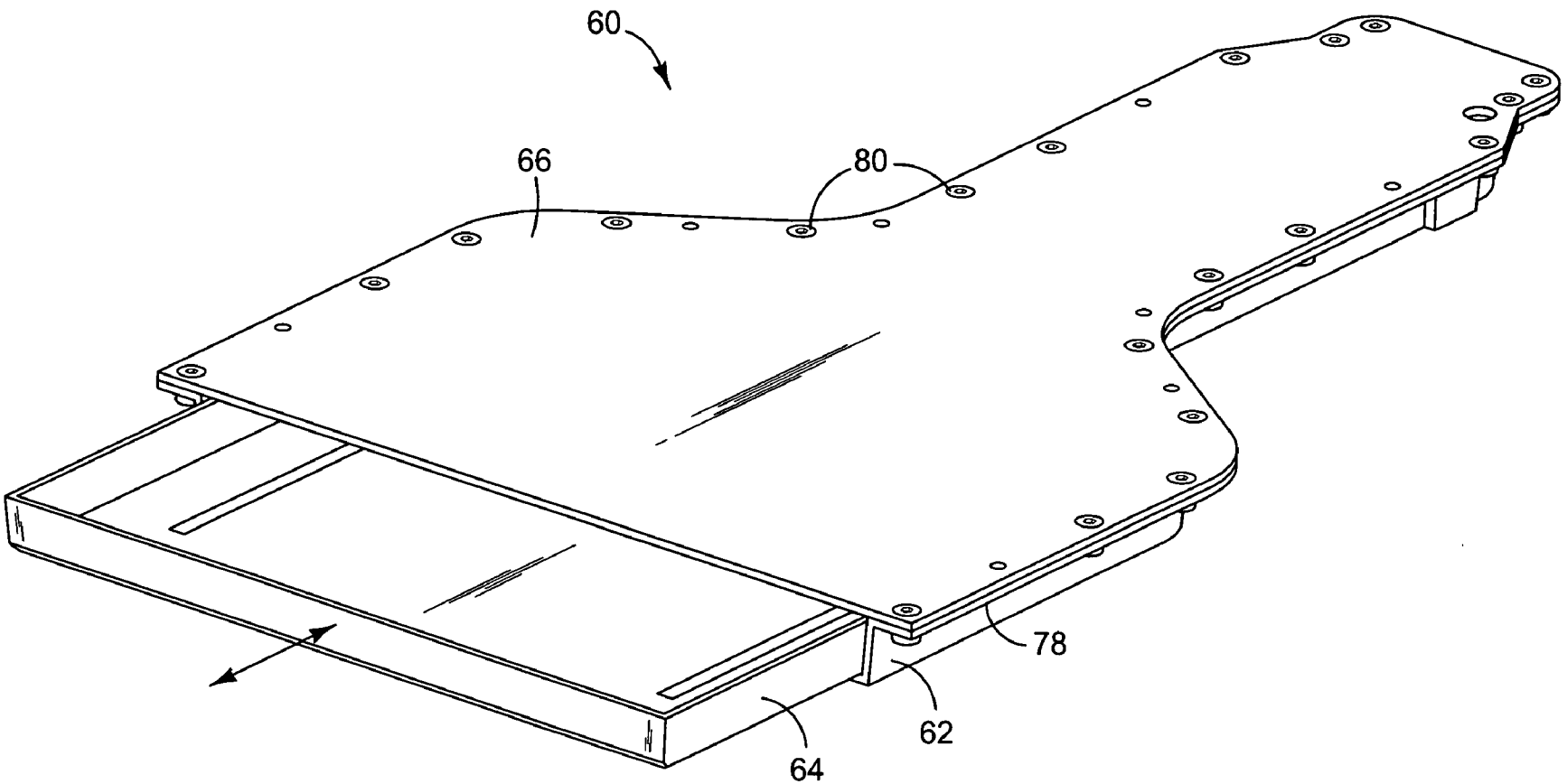
Figure 7:
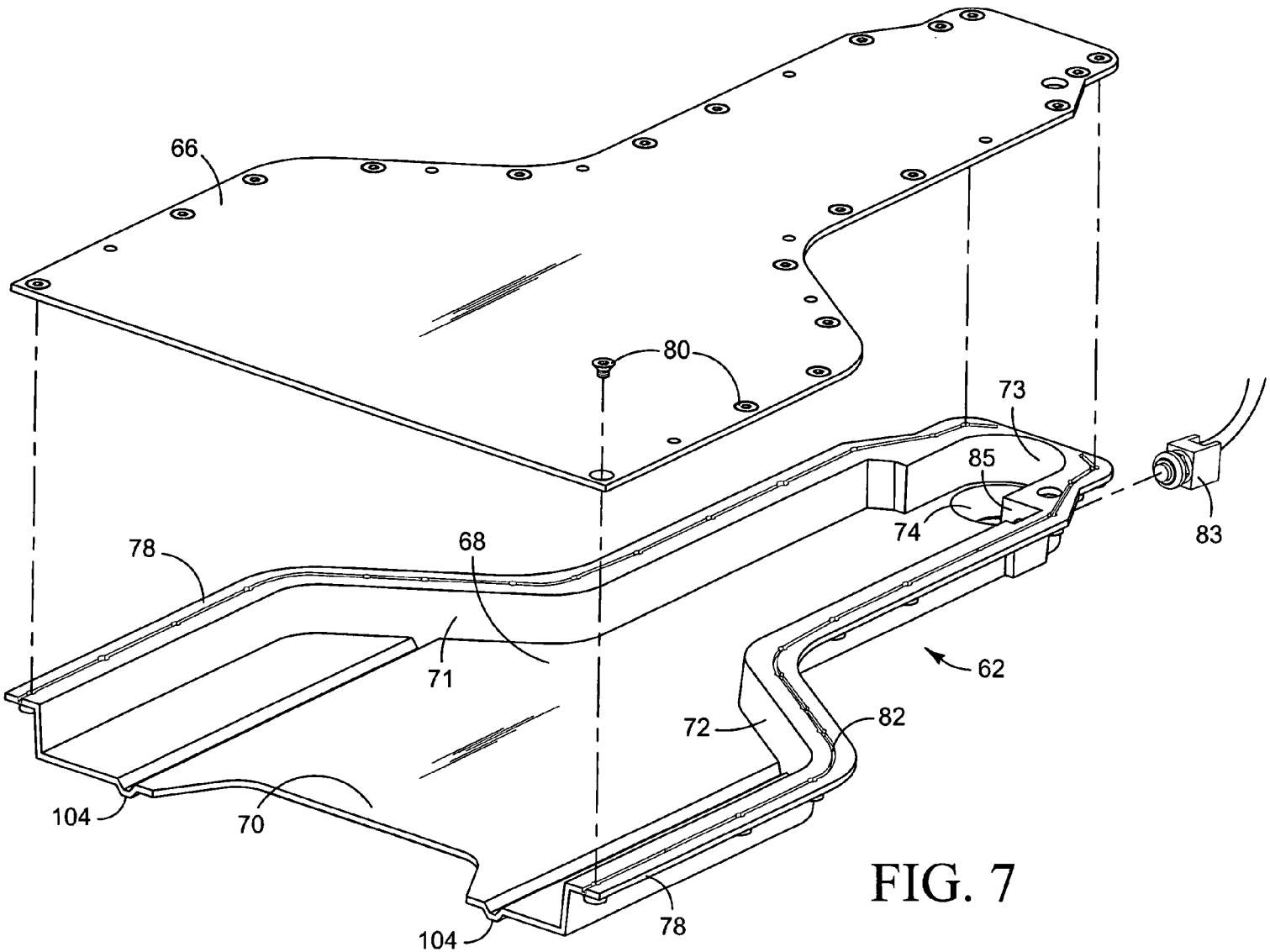
FIG. 7 is a detailed exploded view of the drawer receptacle and cover in the assembly of FIGS. 3-6.
Figure 8:
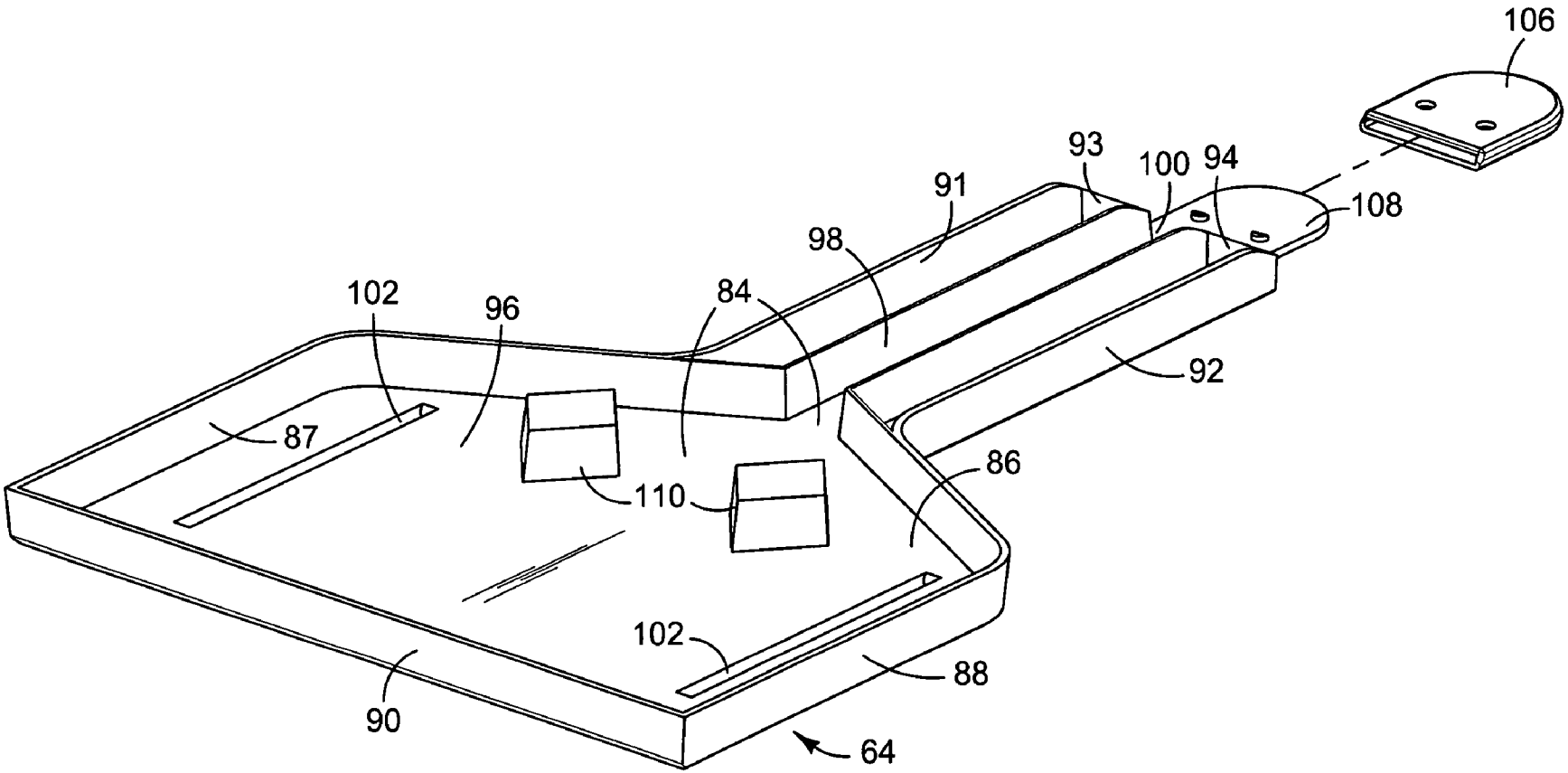
FIG. 8 is a detailed exploded view of the drawer in the assembly of FIGS. 3-6.

FIGS. 3-6 are perspective views of a debris receiver assembly 60 such as might be used in cabinets 10 and 32 of FIGS. 1 and 2. FIG. 7 is a detailed exploded view showing the drawer receptacle and cover from the assembly of FIGS. 3-6. FIG. 8 is a detailed exploded view of the drawer from the assembly of FIGS. 3-6. Referring to FIGS. 3-8, receiver assembly 60 includes a drawer receptacle 62, a debris receiving drawer 64 that slides in receptacle 62 and a cover 66 attached to receptacle 62. Receptacle 62 forms a generally Y-shaped bay 68 defined by a floor 70, cover/ceiling 66, sidewalls 71 and 72, and a rear end wall 73. An opening 74 in floor 70 at the rear of bay 68 forms a suction port 76 (see FIG. 4) that may be connected to ducting in a vacuum system. In the embodiment shown, as best seen in FIGS. 4 and 7, suction port 76 is configured as a stepped cylinder projecting down from floor 70 for connection to round tubular ducting. Of course, other configurations for suction port 70 are possible.

As also seen in FIGS. 4 and 7, cover 66 conforms to the uppermost planar shape of receptacle 62. Cover 66 is attached to a flange 78 along sidewalls 72 of receptacle 62 with screws 80. A groove 82 may be formed along flange 78 as shown in FIG. 7 to contain a gasket, including a ridge on the underside of cover 66 (not shown), to help seal cover 66 to receptacle 62. Other suitable fasteners or attachment techniques and seals may be used. Cover 66 could also be formed as an integral part of receptacle 62 rather than using the two discrete parts shown in the figures. As best seen in FIGS. 4 and 7, an electrical on-off switch 83 is located at the rear of receptacle 62 near the front of suction port 76. Switch 83 is mounted into a small forward facing wall 85 formed at the rear of receptacle 62. Other locations for switch 83 are, of course, also possible.

Figure 6:
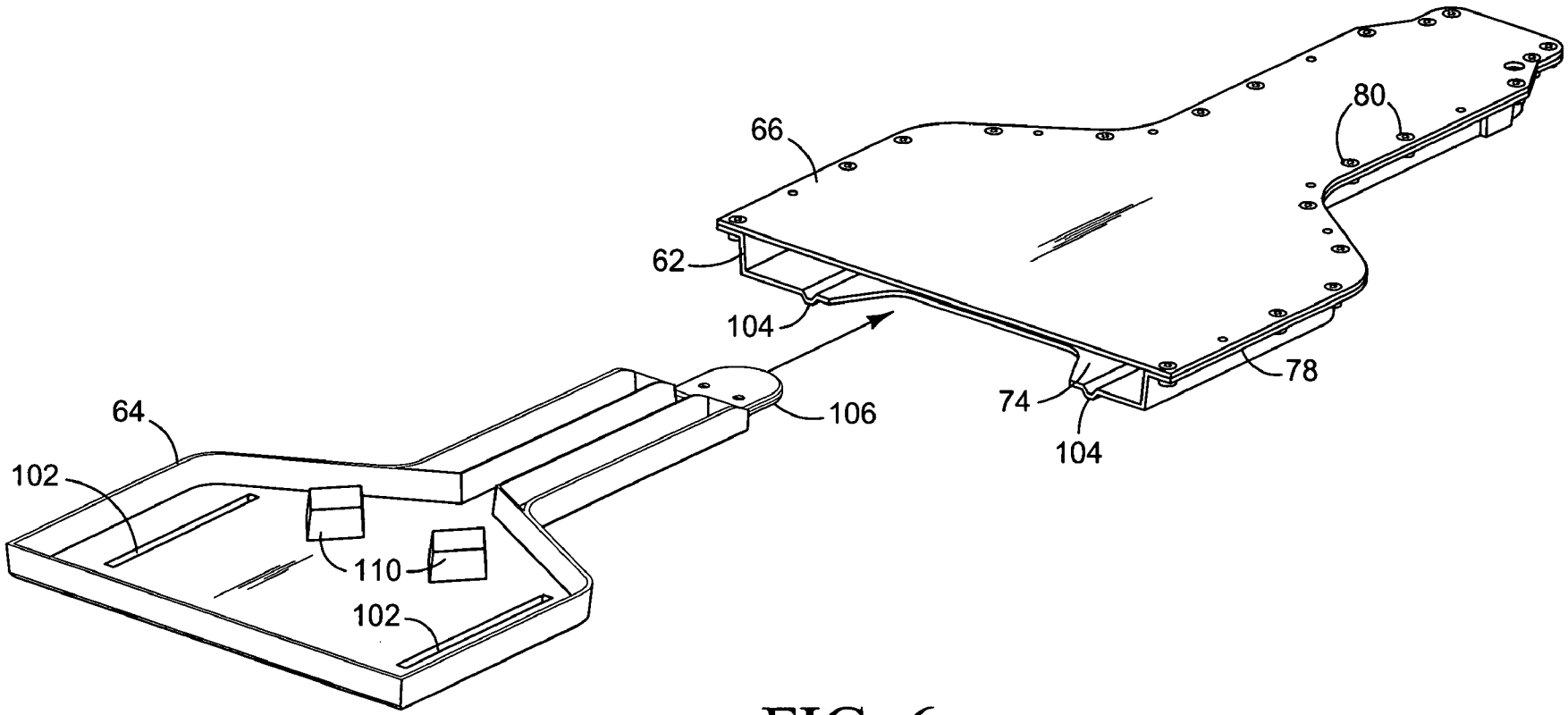

Referring now to FIGS. 6 and 8, drawer 64 forms a generally Y-shaped chamber 84 defined by a floor 86, sidewalls 87 and 88, and a front end wall 90 that extends across the front of drawer 64 between sidewalls 87 and 88. As best seen in FIG. 6, the outer shape of drawer 64 conforms closely to the inner shape of receptacle 62 so that drawer 64 nests inside receptacle 62 fully under cover 66 when drawer 64 is closed. In the embodiment shown, outer perimeter sidewalls 91 and 92, which extend parallel to chamber sidewalls 87 and 88 along the stem of the Y, form the outer perimeter of drawer 64 along this rear portion. Short rear end walls 93, 94 extend between sidewalls 87, 91 and 88, 92 at the rear of drawer 64. Outer perimeter sidewalls 91 and 92 strengthen chamber sidewalls 87 and 88 and rear end walls 93 and 94. One of the rear end walls 93 or 94 is used as a stop at the back of drawer 64 to activate switch 83 (see FIG. 7) to the off position when drawer 64 is closed. For switch 83 located at the rear right of receptacle 62, as shown in FIG. 7, rear end wall 94 is used as the stop.

Referring again to FIG. 8, the more broad forward part of drawer chamber 84 forms a basin 96 into which debris is swept when drawer 64 is open. The more narrow rearward part of chamber 84 forms a channel 98 through which debris is channeled from basin 96 to an outlet 100 at the rear of drawer 64. Air flowing through chamber 84 accelerates as it moves from the broad forward part through the gradually constricting sidewalls 87, 88 into the narrow channel 98 to help move debris toward suction port 76 (see FIG. 4). The tapered sidewalls 87, 88 of the Y-shaped chamber 84 also eliminate deep corners to help debris along the sidewalls move more easily from basin 96 into channel 98. In addition, as drawer 64 closes and suction is applied to an ever diminishing supply of air, the vacuum effect in chamber 84 is greatly increased, making it virtually impossible for any debris to remain in drawer 64 after it is closed.

Referring still to FIG. 8, a pair of rails 102 formed along the floor 86 of drawer 64 slide in tracks 104 formed in the floor 70 of receptacle 62 (see FIG. 7) to help keep drawer 64 properly aligned in receptacle 62. A rubber sleeve 106 fitted onto a tongue 108 extending from the rear of drawer 64 closes suction port 76 (see FIG. 4) when drawer 64 is closed. Sleeve 106 functions as a valve that starts and stops the flow of air through chamber 84. When drawer 64 is closed, sleeve 106 closes port 76 and, when suction is supplied to port 76, seals suction port 76 so that air will not flow through chamber 84. A pair of blocks 110 positioned on either side of channel 98 may be used in drawer 64 as necessary or desirable to reduce air volume in basin 96 and thereby accelerate the speed of air passing through basin 96.

Figure 9:
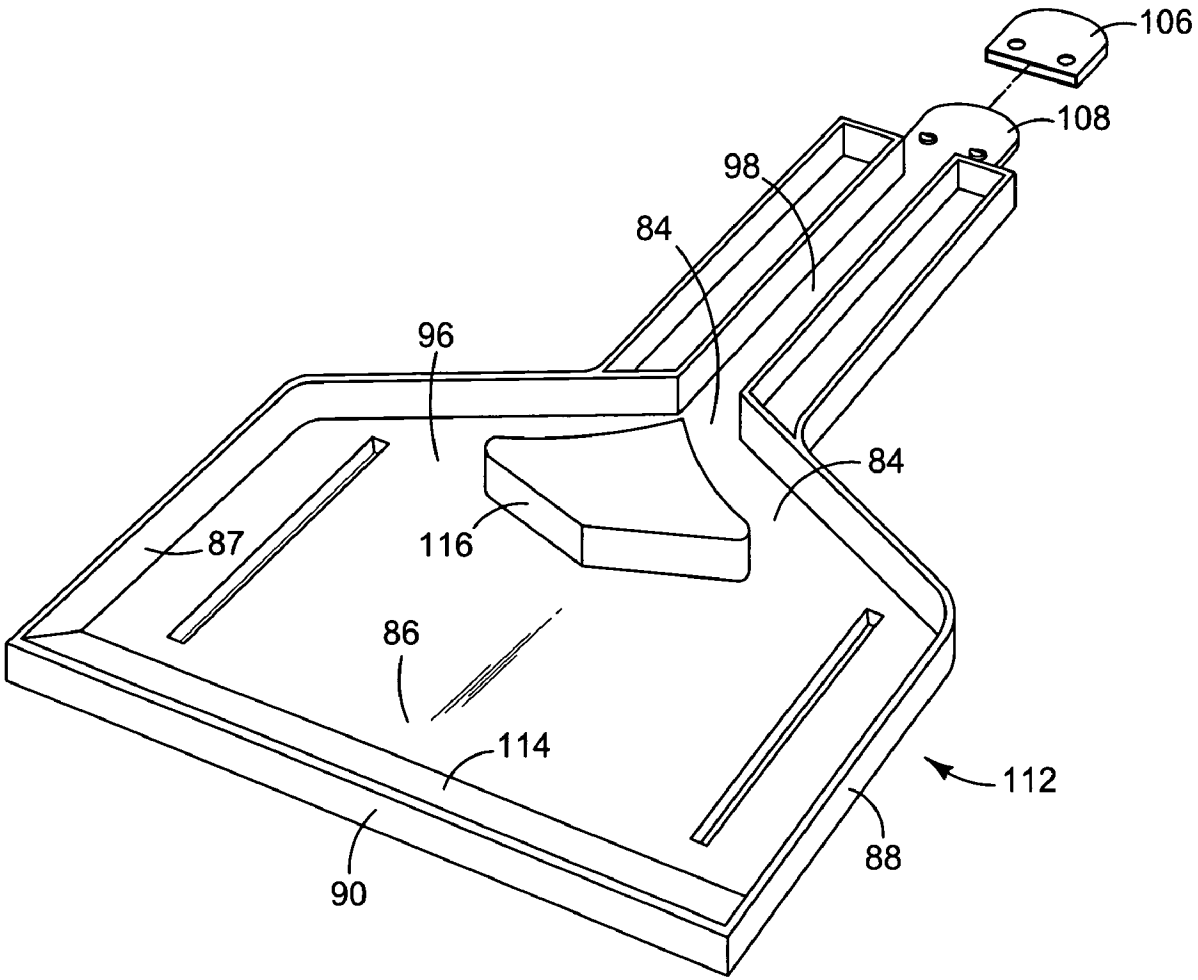
FIG. 9 is another embodiment of a drawer that may be used in the assembly of FIGS. 3-6.

FIG. 9 illustrates another embodiment of a drawer 112 that might be used in a receiver assembly such as the one shown in FIGS. 3-6. Referring to FIG. 9, drawer 112 is substantially the same as drawer 64 shown in FIG. 8 except that drawer 112 includes a ramp 114 providing a sloped transition from front end wall 90 down to floor 86, with a hollowed-out area on the underside (not shown) for use as a finger catch to open the drawer, and a single block 116 positioned in front of channel 98 to reduce air volume and accelerate the speed of air passing through basin 96. The front and rear of block 116 are tapered to help direct debris around block 116 and then in to channel 98.

Figure 10:
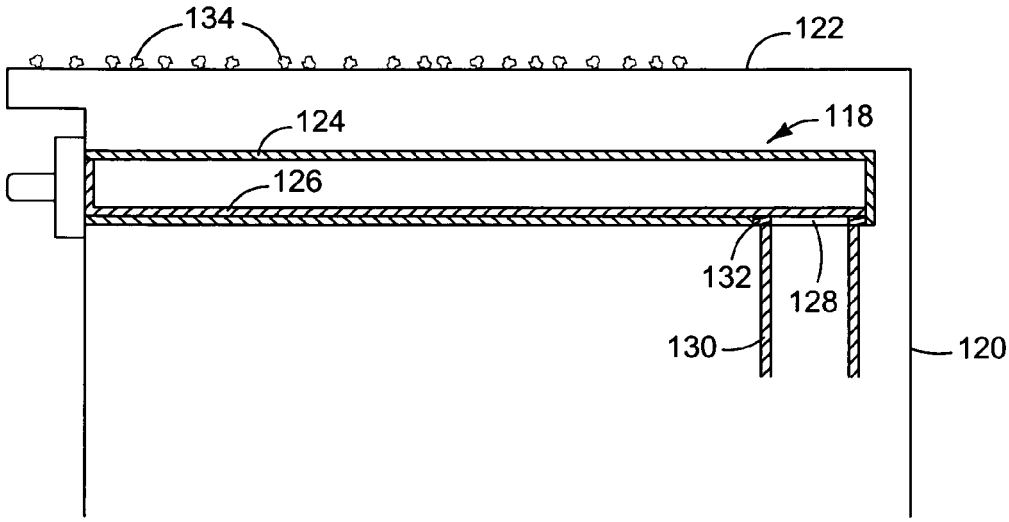
FIGS. 10 and 11 are section views that illustrate collecting debris off a countertop using an embodiment of the invention.
Figure 11:
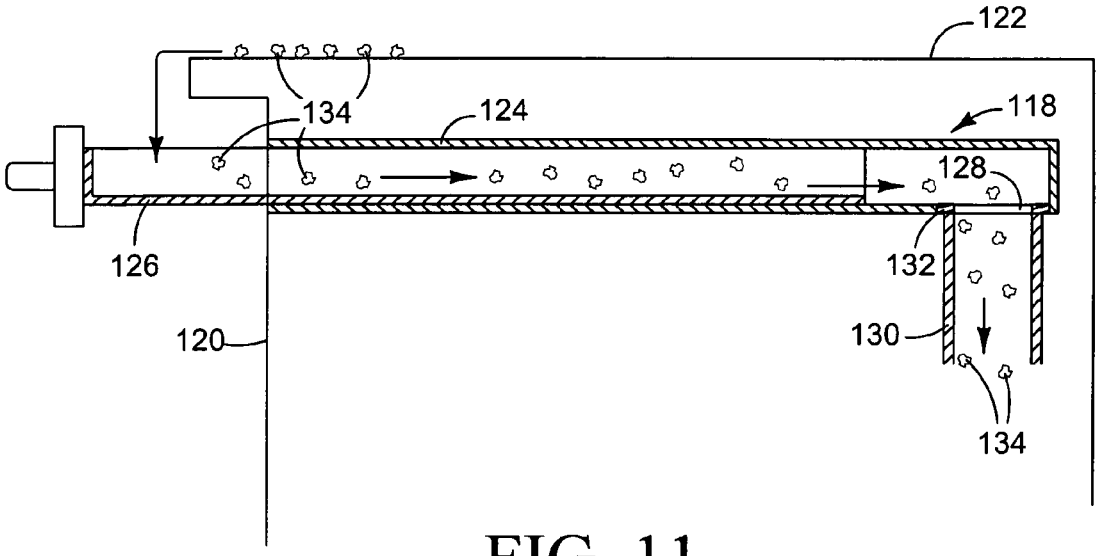

FIGS. 10 and 11 are section views that illustrate collecting debris off a countertop using an embodiment of the invention. Referring to FIGS. 10 and 11, a debris receiver assembly 118 is installed in a cabinet 120 having a countertop 122. Assembly 118 is positioned just below countertop 122. Receiver assembly 118 includes a drawer receptacle 124 and a debris receiving drawer 126 that slides in receptacle 124. A suction port 128 at the rear of receptacle 124 allows air to flow into vacuum duct 130. In this embodiment, a seal 132 is embedded in the floor of receptacle 124 surrounding suction port 128. When drawer 126 is closed (see FIG. 10) and suction is supplied to suction port 128, the floor of drawer 126 seals against seal 132 to prevent the flow of air through port 128 into duct 130. When drawer 126 is open (see FIG. 11), debris 134 falling into drawer 126 is immediately sucked back through suction port 128 into duct 130 and on to the collector in the central vacuum system.

Suction acting on particles of debris 134 as they fall into drawer 126 and before the particles hit the floor of drawer 126 helps minimize the drag that must be overcome to move particles toward suction port 128. Also, after debris 134 is swept into drawer 126 and drawer 126 starts to close, the suction applied to the particles of debris 134 greatly increases to help ensure all debris 134 in drawer 126 is sucked into duct 130. While air flow rates may vary depending on the suction produced by the vacuum pump, the size of the duct/suction port relative to the size of the drawer, and the "efficiency" of the receiver assembly, it is expected that a typical residential vacuum pump producing 350-1,000 airwatts at the pump will generate adequate flow through the debris receiver drawer if the ratio between the exposed area of the open drawer and the area of the duct/suction port is in the range of 14:1-92:1. For example, in a drawer 126 that is nominally 1 inch deep, 11 inches across chamber basin 96 tapering to a 1 inch wide channel 98 (basin 96 and channel 98 are shown in FIGS. 8 and 9), and opening a maximum of 6 inches along parallel sidewalls, the ratio between the exposed area of the fully open drawer 126 and a 1 inch diameter suction port 128 is 84:1. At this ratio, the suction from a typical residential vacuum pump is expected to suck air into the 1 inch diameter suction port 128 through drawer basin 96 at the rate of at least 1,000 feet per minute. This flow rate increases as the ratio between the area of the open drawer and the area of the suction port decreases (for the same drawer depth). As drawer 126 nears full closure, air is sucked through basin 96 at more than 10,000 feet per minute. Even if these flow rates are reduced by 30% to account for air leaking into drawer 126 (reflecting a 70% air leak "efficiency" for receiver assembly 118), the actual flow rates are still expected to be adequate to suck debris through drawer 126 and into suction port 128.

The present invention has been shown and described with reference to the foregoing exemplary embodiments. It is to be understood, however, that other forms, details, and embodiments may be made without departing from the spirit and scope of the invention which is defined in the following claims.

What is claimed is:

1. A drawer for receiving debris into a suction debris collection system, the drawer comprising:

a floor;

walls extending up from the floor, the floor and the walls defining a chamber having a forward part and a rearward part;

an outlet from the rearward part of the chamber; and a seal integral with the drawer and configured to prevent the passage of air through an opening to the suction system when the drawer is closed and suction is supplied to the opening.

2. The drawer of claim 1, wherein the walls comprise sidewalls along opposite sides of the chamber and an end wall between the sidewalls across a front of the chamber.

3. The drawer of claim 1, wherein the chamber tapers from a more broad forward part to a more narrow rearward part.

4. The drawer of claim 1, wherein the outlet comprises an opening in the walls at the rearward part of the chamber.

5. The drawer of claim 1, wherein the seal comprises an extension of the floor extending rearward from the outlet and a sealant on the extension.

6. The drawer of claim 5, wherein the sealant comprises a rubber sleeve.

7. A drawer for receiving debris into a suction debris collection system, the drawer comprising:

a basin;

a channel from the basin;

an outlet from the channel; and a seal configured to prevent the passage of air into a port to the suction system when the drawer is in a closed position and suction is supplied to the port.

8. The drawer of claim 7, wherein:

the basin is configured to guide debris entering the basin toward the channel and accelerate the flow of debris into the channel; and the channel is configured to channel debris to the outlet.

9. A drawer for receiving debris into a suction debris collection system, the drawer comprising:

a floor;

opposing sidewalls extending up from the floor;

an end wall extending across a forward end of the sidewalls, the floor, the sidewalls, and the end wall defining a chamber having a more broad forward part tapering along the legs of a Y-shaped portion of the sidewalls to a more narrow rearward part along the stem of the Y-shaped portion of the sidewalls;

an outlet from the rearward part of the chamber; and a seal configured to prevent the passage of air through an opening to the suction system when the drawer is closed and suction is supplied to the opening.

* * * * *